US009922586B2

(12) United States Patent
Park et al.

(10) Patent No.: US 9,922,586 B2
(45) Date of Patent: Mar. 20, 2018

(54) LOADING EFFECT CONTROL DEVICE AND ORGANIC LIGHT EMITTING DISPLAY DEVICE HAVING THE SAME

(71) Applicant: SAMSUNG DISPLAY CO., LTD., Yongin-si, Gyeonggi-Do (KR)

(72) Inventors: Jung-Kook Park, Cheonan-si (KR); Yong-Kyu Jang, Hwaseong-si (KR)

(73) Assignee: Samsung Display Co., Ltd., Yongin-si, Gyeonggi-do (KR)

( * ) Notice: Subject to any disclaimer, the term of this patent is extended or adjusted under 35 U.S.C. 154(b) by 56 days.

(21) Appl. No.: 14/925,154

(22) Filed: Oct. 28, 2015

(65) Prior Publication Data

US 2016/0125782 A1 May 5, 2016

(30) Foreign Application Priority Data

Oct. 30, 2014 (KR) ..... 10-2014-0149338

(51) Int. Cl.
*G09G 3/30* (2006.01)
*G09G 3/20* (2006.01)
(Continued)

(52) U.S. Cl.
CPC ..... *G09G 3/2003* (2013.01); *G09G 3/3266* (2013.01); *G09G 3/3291* (2013.01); *G09G 3/3696* (2013.01); *G09G 2300/0426* (2013.01); *G09G 2320/0233* (2013.01); *G09G 2320/0242* (2013.01); *G09G 2320/0276* (2013.01); *G09G 2330/028* (2013.01)

(58) Field of Classification Search
CPC .. G09G 3/2003; G09G 3/3291; G09G 3/3266; G09G 2320/0233; G09G 2320/0242; G09G 2310/0254; G09G 2330/028
See application file for complete search history.

(56) References Cited

U.S. PATENT DOCUMENTS

2011/0187693 A1* 8/2011 Chung ..... G09G 5/00 345/211
2011/0242087 A1* 10/2011 Ebisuno ..... G09G 3/3233 345/212

(Continued)

FOREIGN PATENT DOCUMENTS

KR 10-2004-0031513 A 4/2004
KR 10-2008-0045343 A 5/2008

(Continued)

*Primary Examiner* — Kwang-Su Yang
(74) *Attorney, Agent, or Firm* — Lee & Morse, P.C.

(57) ABSTRACT

A loading effect control device includes a detecting line, a detector, a load controller, and a gamma reference voltage generator. The detecting line is coupled to a first power supply line in a display panel, and the first power supply line provides a first power voltage. The detector measures the first power voltage in the display panel through the detecting line, detects an amount of load of the display panel, and outputs a first voltage corresponding to the detected amount of the load. The load controller determines a control amount of the load based on the detected load amount and a loading effect setting. The gamma reference voltage generator controls a gamma reference voltage based on the control amount of the load.

18 Claims, 6 Drawing Sheets

(51) Int. Cl.

| | |
|---|---|
| ***G09G 3/3291*** | (2016.01) |
| ***G09G 3/3266*** | (2016.01) |
| ***G09G 3/36*** | (2006.01) |

(56) References Cited

U.S. PATENT DOCUMENTS

2012/0249514 A1* 10/2012 Ahn ..... G09G 3/3233
345/212
2013/0169693 A1* 7/2013 Pyo ..... G09G 3/3225
345/690

FOREIGN PATENT DOCUMENTS

KR 10-2010-0068075 A 6/2010
KR 10-2012-0100496 A 9/2012

* cited by examiner

LOADING EFFECT CONTROL DEVICE AND ORGANIC LIGHT EMITTING DISPLAY DEVICE HAVING THE SAME

CROSS-REFERENCE TO RELATED APPLICATION

Korean Patent Application No. 10-2014-0149338, filed on Oct. 30, 2014, and entitled, "Loading Effect Control Device and Organic Light Emitting Display Device Having the Same," is incorporated by reference herein in its entirety.

BACKGROUND

1. Field

One or more embodiments described herein relate to a loading effect control device and an organic light emitting display device with a loading effect control device.

2. Description of the Related Art

A variety of flat panel displays have been developed. Examples include liquid crystal displays, field emission displays, plasma display panels, and organic light emitting displays. These displays are lighter and thinner than cathode-ray tube displays.

OLED displays have recently been the subject of particular attention. These displays are thin, low power consumption devices that have a wide viewing angle and rapid response speed. However, in operation, an OLED display may experience a voltage drop that is based on resistance associated with one or more power supply lines and a loading effect. For example, the voltage drop may change based on changes in the loading effect. This may have an adverse influence on gamma voltages that are used to generate images. As a result, display quality may be significantly degraded.

SUMMARY

In accordance with one or more embodiments, a loading effect control device includes a detecting line coupled to a first power supply line in a display panel, the first power supply line to provide a first power voltage; a detector to measure the first power voltage in the display panel through the detecting line, to detect an amount of a load of the display panel by comparing the measured first power voltage with a predetermined first reference voltage, and to output a first voltage corresponding to the detected amount of the load; a load controller to determine a control amount of the load based on the detected load amount and a loading effect setting and to output a second voltage corresponding to the determined control amount of the load; and a gamma reference voltage generator to control a gamma reference voltage based on the determined control amount of the load.

The detector may measure the first power voltage of the first power supply line at a position in which a voltage drop occurs. The first voltage may be based on a difference between the first power voltage and the first reference voltage. The predetermined first reference voltage may be based on the first power voltage measured when a white image is displayed on the display panel.

The load controller may include a first decoder to determine a magnitude of the control amount of the load based on the detected load amount and the loading effect setting; and a second decoder to determine a polarity of the control amount of the load based on the loading effect setting. The first decoder may generate divided voltages by dividing the first voltage based on a predetermined ratio, and output one of the divided voltages as a third voltage based on the loading effect setting. The second decoder may include an inverter to reverse a polarity of the third voltage; and a buffer to maintain the polarity of the third voltage. The first decoder may be selectively coupled to the inverter or the buffer. The gamma reference voltage generator may include an operational amplifier to add the second voltage corresponding to the control amount of the load to a second reference voltage.

In accordance with one or more other embodiments, an organic light emitting display device includes a display panel including a plurality of pixels; a power supplier to provide a first power voltage and a second power voltage to the display panel; a loading effect controller to calculate a difference between the first power voltage measured from the display panel and a predetermined first reference voltage, the difference corresponding to a detected amount of a load of the display panel, determine a control amount of the load based on the detected load amount and a loading effect setting, and to control a gamma reference voltage based on the determined control amount of the load; a data driver to provide a data signal to the display panel; a scan driver to provide a scan signal to the display panel; and a timing controller to generate a control signal to control the data driver and the scan driver.

The loading effect controller may include a detecting line coupled a first power supply line in the display panel, the first power supply line to provide a first power voltage; a detector to measure the first power voltage in the display panel through the detecting line, to detect to the amount of the load of the display panel by comparing the measured first power voltage to with a predetermined first reference voltage, and to output a first voltage corresponding to the detected amount of the load; a load controller to determine the control amount of the load based on the detected load amount and the loading effect setting and to output a second voltage corresponding to the determined control amount of the load; and a gamma reference voltage generator to control the gamma reference voltage based on the determined control amount of the load.

The detector may measure the first power voltage of the first power supply line at a position in which a voltage drop occurs. The detector may include a comparator to output the first voltage based on a difference between the first power voltage and the predetermined first reference voltage. The predetermined first reference voltage may be based on the first power voltage measured when a white image is displayed on the display panel.

The load controller may include a first decoder to determine an a magnitude of the control amount of the load based on the detected load amount and the loading effect setting; and a second decoder to determine a polarity of the control amount of the load based on the loading effect setting. The first decoder may generate divided voltages by dividing the first voltage based on a predetermined ratio, and output one of the divided voltages as a third voltage based on the loading effect setting. The second decoder may include an inverter to reverse a polarity of the third voltage; and a buffer to maintain the polarity of the third voltage. The first decoder may be selectively coupled to the inverter or the buffer.

The gamma reference voltage generator may include an operational amplifier to add the second voltage corresponding to the control amount of the load to a predetermined second reference voltage. The loading effect controller may be included in a timing controller or is coupled to the timing controller.

In accordance with one or more other embodiments, an apparatus includes an output and a controller to determine a control amount of a load of a display panel based on a detected amount of the load of the display panel and a loading effect setting, and to output a voltage corresponding to the control amount of the load, wherein the voltage is to be sent through the output to a gamma reference voltage generator to control a gamma reference voltage. The controller may measure a power voltage at a predetermined position in the display panel and to detect the amount of the load of the display panel by comparing the measured first power voltage with a reference voltage.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
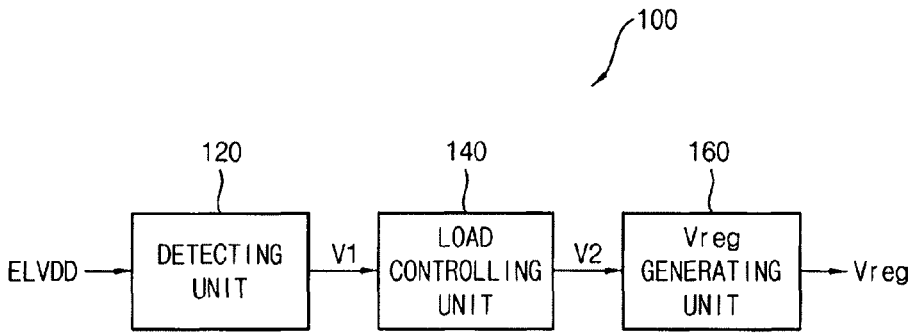
FIG. 1 illustrates an embodiment of a loading effect control device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. In the drawings, the dimensions of layers and regions may be exaggerated for clarity of illustration. Like reference numerals refer to like elements throughout.

During operation of a display device, a phenomenon known as "loading effect" may cause gamma voltages to deviate from predetermined values. This deviation may change the brightness of grayscale values in an image. In one case, the deviation in gamma voltages may change an on-pixel ratio of the image, which may adversely affect display quality. In accordance with one or more embodiments, a device is provided for controlling the loading effect in a display device, in order to improve display quality.

Figure 2:
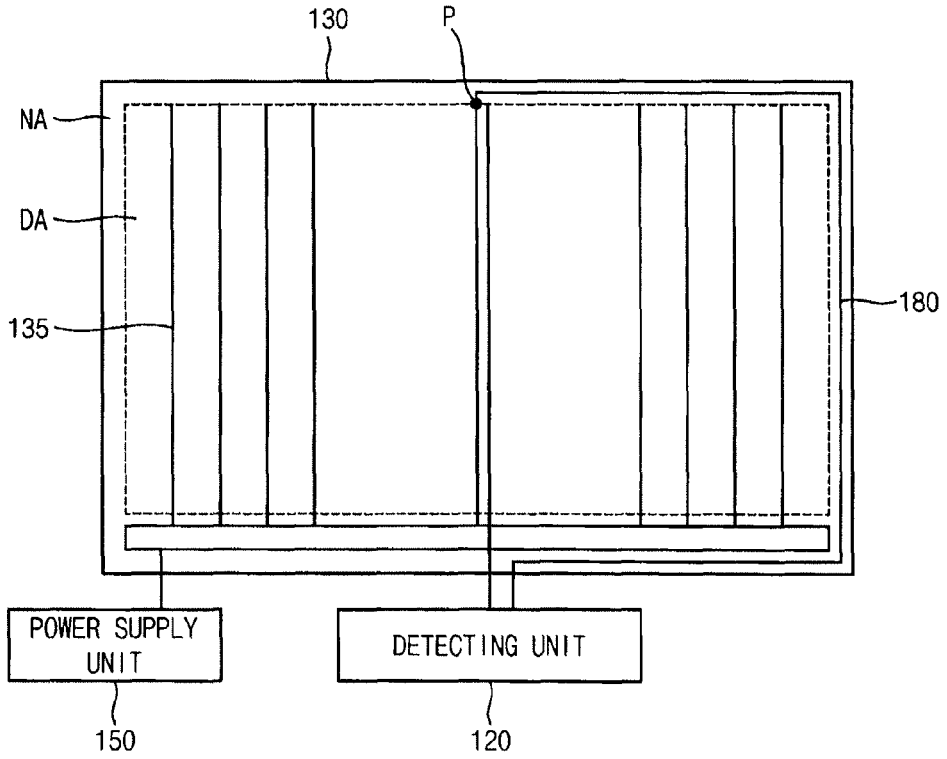
FIG. 2 illustrates an example of a detecting line and a detecting device.

FIG. 1 illustrates an embodiment of a loading effect control device 100, and FIG. 2 illustrates an example of a detecting line and a detecting device, which, for example, may be included in the loading effect control device of FIG. 1. As will be explained in greater detail, the loading effect control device 100 calculates a load amount based on a first power voltage ELVDD and then controls a gamma reference voltage Vreg based on a value determined by the load amount and/or one or more loading effect settings.

Referring to FIGS. 1 and 2, the loading effect control device 100 includes a detecting unit 120, a load controlling unit 140, a gamma reference voltage (Vreg) generating unit, and a detecting line 180.

The detecting line 180 may be coupled to a first power supply line 135 in a display panel 130. A first power voltage ELVDD may be supplied through the first power supply line 135. The first power voltage ELVDD may be, for example, a high power voltage provided to the display panel 130. The first power voltage ELVDD is generated in a power supply unit 150, and may be provided to each of pixels of the display panel 130 through the first power supply line 135. Here, the first power voltage ELVDD may experience a voltage drop based on an internal resistance of a line that couples the power supply unit 150 to the display panel 130 and/or an internal resistance of the first power supply line 135.

The detecting line 180 may be coupled to the first power supply line 135 at a predetermined position relative to (e.g., relatively far from) the power supply unit 150 that supplies the first power voltage ELVDD. The detecting unit 120 measures the first power voltage ELVDD of the first power supply line 135 at which a voltage drop occurs through the detecting line 180. When the display panel 130 has a relatively low resolution, the detecting line 180 may be formed in a straight line across a display area DA of the display panel 130. When the display panel 130 has a relatively high resolution, the detecting line 180 may be formed in a straight line along a non-display area NA of the display panel 130, because a plurality of lines and a plurality of pixels are arranged in the display area DA of the display panel 130. In another embodiment, the predetermined position may be at an intermediate position relative to the power supply unit. The intermediate location may be one that experiences a voltage drop, albeit perhaps not as significant as an outermost position. The predetermined position may be determined, for example, based on the intended application or tolerances generating an improved quality image The detecting unit 120 measures the first power voltage ELVDD in the display panel 130 through the detecting line 180, detects an amount of a load of the display panel 130 by comparing the measured first power voltage ELVDD with a predetermined first reference voltage, and outputs a first voltage V1 corresponding to the detected amount of the load. The detecting unit 120 may measure the first power voltage ELVDD of the first power supply line 135 at which the voltage drop occurs through the detecting line 180, because the detecting line 180 is coupled to the first power supply line 135 at the position far from the power supply unit 150.

The detecting unit 120 may detect the amount of load of the display panel 130 by comparing the measured first power voltage ELVDD with the predetermined first reference voltage. The detecting unit 120 may output the first voltage V1 corresponding to the detected load amount. The first reference voltage may be the first power voltage ELVDD when a white image is displayed on the display panel 130. The amount of voltage drop of the first power voltage ELVDD may be a maximum when the white image is displayed because the on-pixel ratio of the display panel 130 is 100% at this time. The detecting unit 120 may include a comparator that outputs a difference between the first power voltage ELVDD and the first reference voltage as the first voltage V1.

The load controlling unit 140 determines a control amount of the load based on the detected load amount and a loading effect setting provided from a timing controller. The load controlling unit 140 outputs a second voltage V2 corresponding to the determined control amount of the load. The loading effect setting may determine a magnitude and a polarity of the control amount of the load. The loading effect setting may be stored, for example, in the timing controller during a manufacturing process.

The loading effect setting may be set based on a product usage environment and/or based on a user selection. The loading effect setting may be input to the timing controller when the display device is driven. In one embodiment, the load effect setting may be determined so that the control amount of the load has a positive value, for example, when the display device is used in outside environment or under one or more predetermined first environmental conditions. The loading effect setting may be determined so that the control amount of the load has a negative value, for example, when the display device is used indoors or under one or more predetermined second environmental conditions. The first and second environmental conditions may differ, for example, based on differences in temperature, humidity, glare, lighting conditions, or other conditions or parameters.

The load controlling unit 140 may include a first decoder and a second decoder. The first decoder determines the magnitude of the control amount of the load based on the detected load amount and the loading effect setting. The second decoder determines the polarity of the control amount of the load based on the loading effect setting.

In one embodiment, the first decoder generates divided voltages by dividing the first voltage V1 based on a predetermined ratio and outputs one of the divided voltages as a third voltage based on the loading effect setting. The second decoder may include an inverter that reverses the polarity of the third voltage and a buffer that maintains the polarity of the third voltage. The first decoder may be selectively coupled to the inverter of the second decoder or the buffer of the second decoder according to the loading effect setting. The load controlling unit 140 outputs the second voltage V2 corresponding to the control amount of the load with a magnitude and polarity determined in the first decoder and the second decoder.

The gamma reference voltage generating unit 160 controls a gamma reference voltage Vreg according to the determined control amount of the load. The gamma reference voltage Vreg may be provided to a gamma voltage generating unit. The gamma voltage generating unit generates a plurality of gamma voltages based on the gamma reference voltage Vreg. The gamma reference voltage generating unit 160 may increase or decrease the gamma reference voltage Vreg according to the control amount of the load. In one embodiment, the gamma reference voltage generating unit 160 includes an operational amplifier that adds the second voltage V2, corresponding to the control amount of the load, to a predetermined second reference voltage. The second reference voltage may generate the gamma voltages to correspond to a predetermined gamma curve.

The gamma reference voltage generating unit 160 may generate the gamma reference voltage Vreg to be higher than the second reference voltage when the second voltage V2 has a positive value. In this case, an outside visibility of the display device may be improved by increasing the voltage levels of the gamma voltages generated in the gamma voltage generating unit.

The gamma reference voltage generating unit 160 may generate the gamma reference voltage Vreg to be lower than the second reference voltage when the second voltage V2 has a negative value. In this case, the color accuracy of the display device may be improved by decreasing the voltage levels of the gamma voltages generated in the gamma voltage generating unit. The display device includes the display panel 130.

Thus, the loading effect control device 100 measures the first power voltage ELVDD in the display panel through the detecting line 180, calculates the amount of load of the display panel by comparing the measured first power voltage ELVDD with the first reference voltage, and generates the gamma reference voltage Vreg by determining the control amount of the load based on the calculated load amount and the loading effect setting. Thus, the color accuracy of the display panel 130 and the visibility of the display panel 130 may be improved.

Figure 3:
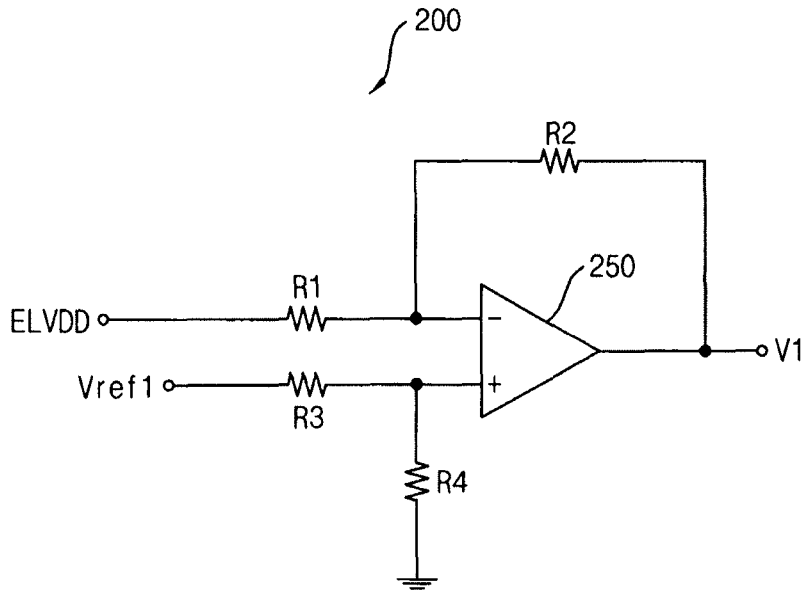
FIG. 3 illustrates an embodiment of a detecting unit.

FIG. 3 illustrates an embodiment of the detecting unit 200, which, for example, may be included in the loading effect control device of FIG. 1. The detecting unit 200 measures the first power voltage ELVDD in the display panel through a detecting line, detects an amount of load of the display panel by comparing the measured first power voltage ELVDD with a predetermined first reference voltage Vref1, and outputs a first voltage corresponding to the detected amount of the load.

Referring to FIG. 3, the detecting unit 200 includes a comparator 250, a first resistor R1, a second resistor R2, a third resistor R3, and a fourth resistor R4. The comparator 250 includes a first input terminal, a second input terminal, and an output terminal. The first resistor R1 may be coupled between the detecting line and the first input terminal of the comparator 250. The second resistor R2 may be coupled between the first input terminal of the comparator 250 and the output terminal of the comparator 250. The third resistor R3 may be coupled between a first reference voltage source and the second input terminal of the comparator 250. The fourth resistor R4 may be coupled between the second input terminal and a ground connection.

The comparator 250 outputs a difference between the first power voltage ELVDD, that is provided to the first input terminal through the detecting line, and the first reference voltage Vref1 provided to the second terminal from a first reference voltage source. The first reference voltage may be the first power voltage measured, for example, when a white image is displayed on the display panel. The first voltage V1 may be provided to a load controlling unit.

Figure 4:
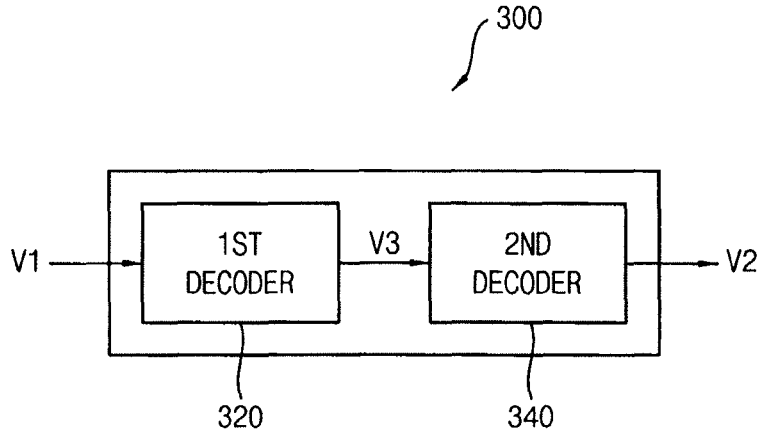
FIG. 4 illustrates an embodiment of a load controlling unit.
Figure 5:
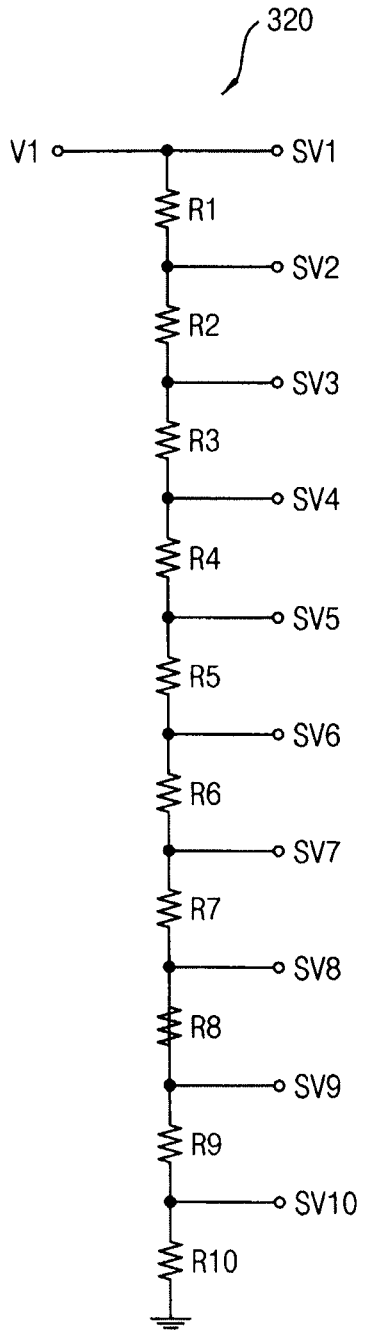
FIG. 5 illustrates an embodiment of a first decoder.
Figure 6A:
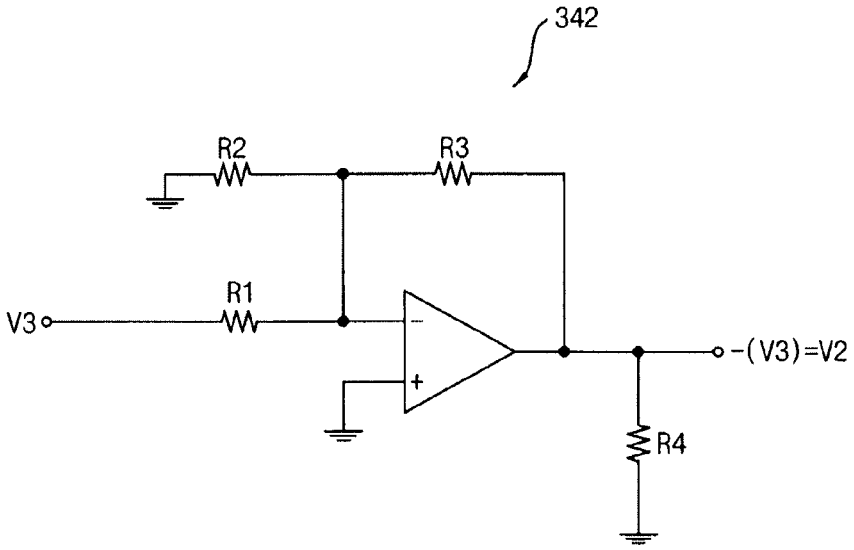
FIGS. 6A and 6B illustrate an embodiment of a second decoder.
Figure 6B:
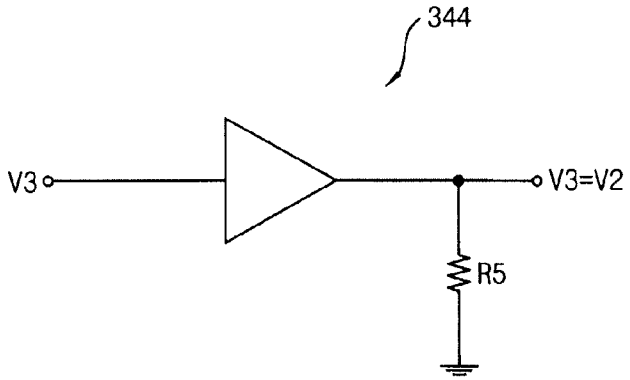

FIG. 4 illustrates an embodiment of the load controlling unit 300 in the loading effect control device of FIG. 1. FIG. 5 illustrates an embodiment of first decoder in the load controlling unit 300 of FIG. 4. FIGS. 6A and 6B illustrate an embodiment of a second decoder in the load controlling unit 300 of FIG. 4.

Referring to FIG. 4, the load controlling unit 300 includes a first decoder 320 and a second decoder 340. The first decoder 320 determines the magnitude of a control amount of a load based on a detected amount of the load and the loading effect setting.

Referring to FIG. 5, the first decoder 320 generates divided voltages by dividing a first voltage V1 based on a predetermined ratio and outputs one of the divided voltages as a third voltage V3. For example, the first decoder 320 includes a first through a tenth resistor R1 thorough R10 and generates a plurality of divided voltages SV1 through SV10 based on the first voltage V1. One of the divided voltages SV1 through SV10 may be selected according to the loading effect setting and may be provided to the second decoder 340 as the third voltage V3.

In one example embodiment, the first decoder 320 includes a multiplexer which selects one of the divided voltages SV1 through SV10 based on the loading effect setting and which provides the selected divided voltage to the second decoder 340 as the third voltage V3. In another example embodiment, each of output terminals of divided voltages SV1 through SV10 of the first decoder 320 include a switch that couples the corresponding output terminal of the divided voltages SV1 through SV10 to the second decoder 340. The switches may turn on or turn off according to a control signal from a switch control unit. The switch control unit may turn on one of the switches to couple a corresponding one of the output terminals of the divided voltages SV1 through SV10 to the second decoder 340 based on the loading effect setting.

The second decoder 340 may determine the polarity of the control amount of the load according to the loading effect setting. Referring to FIGS. 6A and 6B, the second decoder 340 may include an inverter 342 and a buffer 344. The third voltage V3 output from first decoder 320 may be selectively provided to the inverter 342 or the buffer 344 based on the loading effect setting. The inverter 342 may reverse a polarity of the third voltage V3. The inverter 342 may output the third voltage V3 that has a positive value as a second voltage V2 that has a negative value by reversing the polarity of the third voltage V3. The inverter 342 may output the third voltage V3 that has a negative value as the second voltage V2 that has a positive value by reversing the polarity of the third voltage V3. The buffer 344 may maintain the polarity of the third voltage V3, e.g., the buffer 344 may output the third voltage V3 equal to the second voltage V2.

The load controlling unit 300 may output the second voltage (corresponding to the control amount of the load) having an amount and polarity determined in the first decoder 320 and the second decoder 340.

Figure 7:
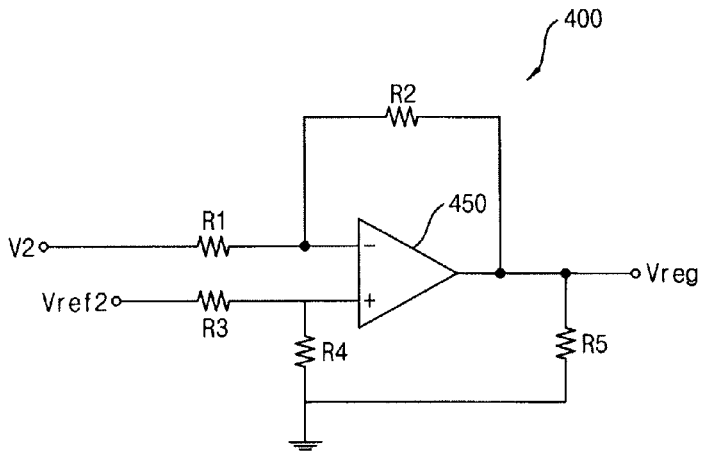
FIG. 7 illustrates an embodiment of a gamma reference voltage generating unit.

FIG. 7 illustrating an embodiment of a gamma reference voltage generating unit 400 in the loading effect control device of FIG. 1. Referring to FIG. 7, the gamma reference voltage generating unit 400 controls the gamma reference voltage Vreg based on the second voltage V2 from a load controlling unit.

Referring to FIG. 7, the gamma reference voltage generating unit 400 includes an operational amplifier 450, a first resistor R1, a second resistor R2, a third resistor R3, a fourth resistor R4, and a fifth resistor R5.

The operational amplifier 450 may include a first input terminal, a second input terminal, and an output terminal. The first resistor R1 is coupled between a load controlling unit and the first input terminal. The second resistor R2 is coupled between the first input terminal and the output terminal. The third resistor R3 is coupled between a second reference voltage source and the second input terminal. The fourth resistor R4 is coupled between the second input terminal and a ground connection. The fifth resistor R5 is coupled between the output terminal and the ground connection.

The second voltage from the load controlling unit may have a negative value or a positive value. The operational amplifier 450 may control the gamma reference voltage Vreg by adding the second voltage V2 to a predetermined second reference voltage Vref2. The second reference voltage Vref2 may generate gamma voltages corresponding to a predetermined gamma curve.

The gamma reference voltage generating unit 400 generates gamma reference voltage Vreg to be higher than the second reference voltage Vref2, for example, when the second voltage V2 has a positive value. In this case, outside visibility of the display device (or in an otherwise high glare or adverse lighting environment) may be improved by increasing the voltage levels of the gamma voltages generated in the gamma voltage generating unit.

The gamma reference voltage generating unit 400 generates the gamma reference voltage Vreg to be lower than the second reference voltage, for example, when the second voltage V2 has a negative value. In this case, the color accuracy of the display may be improved by decreasing the voltage levels of the gamma voltages generated in the gamma voltage generating unit.

Figure 8:
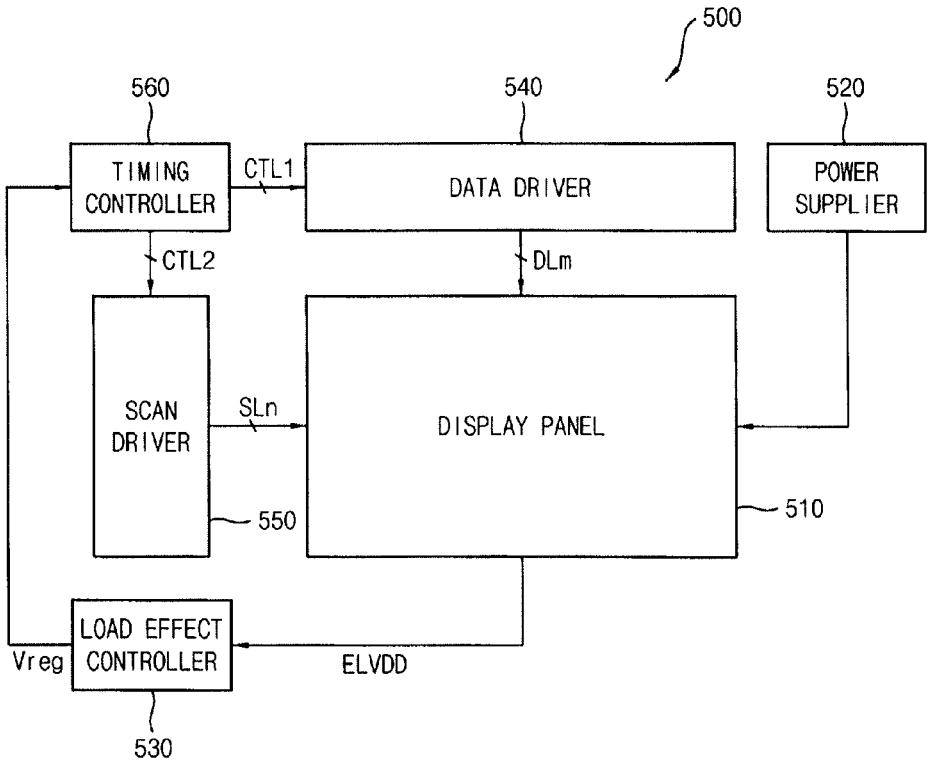
FIG. 8 illustrates an embodiment of an organic light emitting display device.

FIG. 8 illustrates an embodiment of an organic light emitting display device 500 which includes a display panel 510, a power supplier 520, a loading effect controller 530, a data driver 540, a scan driver 550, and a timing controller 560. The loading effect controller 530 may correspond to any of the aforementioned embodiments.

The display panel 510 includes a plurality of pixels. Each pixel has a pixel circuit which includes, for example, a driving transistor and an organic light emitting diode. The pixel circuit controls current flowing through the organic light emitting diode based on a data signal provided via a data line DLm based on a scan signal provided via a scan line SLn. The organic light emitting diode emits light based on the current.

A detecting line may be formed in the display panel 510. The detecting line may be coupled to a first power supply line in the display panel 510. A first power voltage ELVDD may be supplied through the first power supply line. For example, the first power voltage ELVDD may be a high power voltage provided to the display panel 510. The first power voltage ELVDD is generated in a power supplier 520, and is provided to each of pixels of the display panel 510 through the first power supply line. The detecting line may be coupled to the first power supply line at a position far from the voltage supplier 520 that supplies the first power voltage ELVDD. The loading effect controller 530 measures the first power voltage ELVDD of the first power supply line which experiences a voltage drop through the detecting line.

The power supplier 520 provides the first power voltage ELVDD and a second power voltage ELVSS to drive the pixels of the display panel 510.

The loading effect controller 530 calculates a difference between the first power voltage ELVDD measured from the display panel 510 and a predetermined first reference voltage. This difference may correspond to a detected amount of load of the display panel 510. The loading effect controller 530 determines a control amount of a load based on the detected amount of the load and a loading effect setting, and controls a gamma reference voltage based on the determined control amount of the load.

The loading effect controller 530 includes, for example, a detecting unit, a load controlling unit, a gamma reference voltage generating unit, and the detecting line. The detecting line may be coupled to the first power supply line in the display panel. The first power voltage ELVDD may be supplied through the first power supply line. The detecting unit may measure the first power voltage ELVDD in the display panel 510 through the detecting line, detect the amount of load of the display panel 510 by comparing the measured first power voltage ELVDD with a predetermined first reference voltage, and output a first voltage corresponding to the detected load amount.

The detecting unit measures the first power voltage of the first power supply line having a voltage drop that occurs through the detecting line, because the detecting line is coupled to the first power supply line at a position far from the voltage supplier 520.

The detecting unit detects the amount of load of the display panel 510 by comparing the first power voltage ELVDD with the predetermined first reference voltage. The detecting unit outputs the first voltage corresponding to the detected load amount. The predetermined first reference voltage may be the first power voltage ELVDD measured, for example, when a white image is displayed on the display panel 510. The detecting unit may include a comparator that outputs the difference between the first power voltage ELVDD and the predetermined first reference voltage as the first voltage.

The load controlling unit determines a control amount of the load based on the detected amount of the load and the loading effect setting from the timing controller 560. The load controlling unit outputs a second voltage corresponding to the determined control load amount. The loading effect setting may determine, for example, the magnitude and/or polarity of the control load amount. The loading effect setting may be stored in the timing controller 560 during a manufacturing process and/or may be input to the timing controller 560 when the display device is driven.

The load controlling unit may include a first decoder and a second decoder. The first decoder determines the magnitude of the control amount of the load based on the detected load amount and the loading effect setting. The second decoder determines the polarity of the control amount of the load based on the loading effect setting. The first decoder generates divided voltages by dividing the first voltage based on a predetermined ratio, and outputs one of the divided voltages as a third voltage based on the loading effect setting.

The second decoder may include inverter that reverses the polarity of the third voltage and a buffer that maintains the polarity of the third voltage. The first decoder may be selectively coupled to the inverter of the second decoder or the buffer of the second decoder according to the loading effect setting. The load controlling unit outputs the second voltage corresponding to the control amount of the load having the magnitude and polarity determined by the first decoder and the second decoder.

The gamma reference voltage generating unit controls the gamma reference voltage Vreg based on the control amount of the load determined by the load controlling unit. The gamma reference voltage Vreg is provided to a gamma voltage generating unit, which, for example, may be included in or coupled to the timing controller 560. The gamma voltage generating unit generates a plurality of gamma voltages based on the gamma reference voltage Vreg.

The gamma reference voltage generating unit may include an operational amplifier that adds the second voltage corresponding to the control amount of the load to a predetermined second reference voltage. The second reference voltage may generate the gamma voltages corresponding to a predetermined gamma curve. The gamma reference voltage generating unit generates the gamma reference voltage Vreg to be higher than the second reference voltage when the second voltage has a positive value. In this case, outside visibility of the display device (that includes the display panel 510) may be improved by increasing the voltage levels of the gamma voltages generated in the gamma voltage generating unit.

The gamma reference voltage generating unit generates the gamma reference voltage Vreg to be lower than the second reference voltage when the second voltage has a negative value. In this case, color accuracy of the display device (that includes the display panel 510) may be improved by decreasing the voltage levels of the gamma voltages generated in the gamma voltage generating unit. The loading effect controller 530 may, for example, be included in or coupled to the timing controller 560. An example of the loading effect controller 530 that is coupled to the timing controller 560 is described with reference to FIG. 8.

The scan driver 550 provides a scan signal to the pixels via the scan lines SLn. The data driver 540 provides a data signal to the pixels via the data lines DLm according to the scan signal. The timing controller 560 generate one or more control signals that controls the data driver 540 and the scan driver 550.

Thus, the organic light emitting display device 500 includes the loading effect controller 530 that controls the gamma reference voltage based on the amount of load and the loading effect setting. The loading effect controller 530 measures the first power voltage ELVDD in the display panel 510 through the detecting line, calculates the amount of the load of the display panel 510 by comparing the measured first power voltage ELVDD with the first reference voltage, and generates the gamma reference voltage Vreg by determining the control amount of the load based on the amount of load and the loading effect setting. Thus, the color accuracy and visibility of the display panel 530 may be improved.

Figure 9:
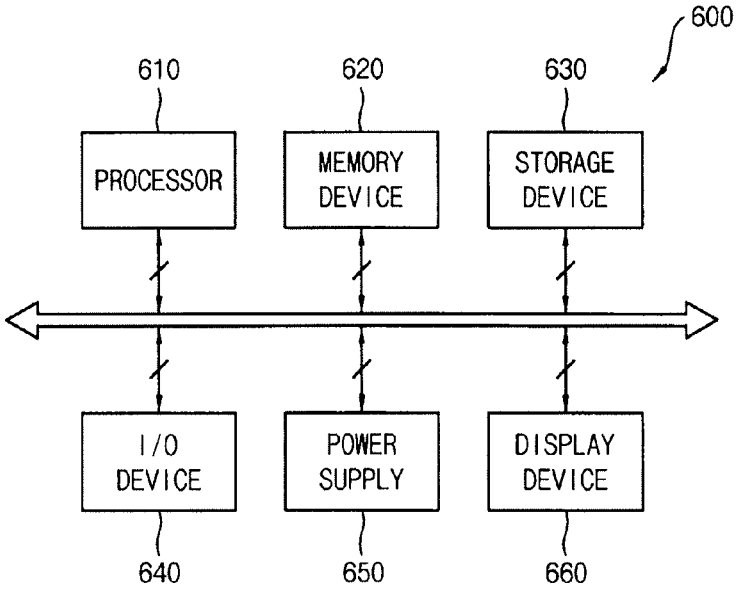
FIG. 9 illustrates an embodiment of an electronic device.
Figure 10:
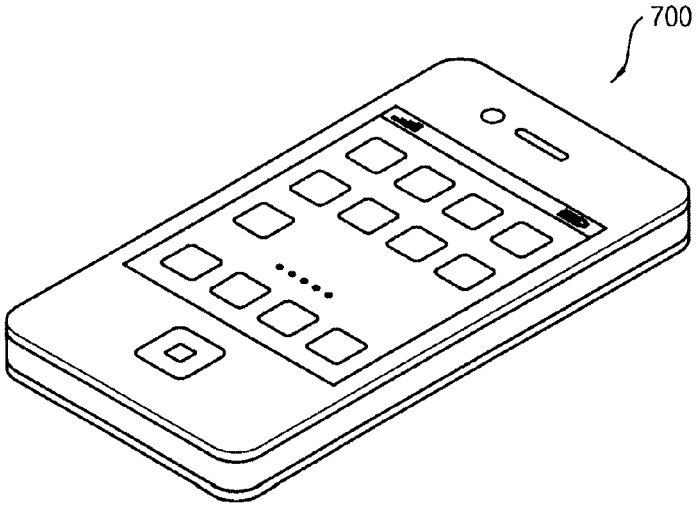
FIG. 10 illustrates an embodiment of a smart phone.

FIG. 9 illustrates an embodiment of an electronic device 600 that includes the organic light emitting display device of FIG. 8, and FIG. 10 illustrates an example embodiment of the electronic device in FIG. 9 in the form of a smart phone.

Referring to FIGS. 9 and 10, the electronic device 600 includes a processor 610, a memory device 620, a storage device 630, an input/output (I/O) device 640, a power supply 650, and a display device 660. The display device 660 may correspond to the organic light emitting display device 500 of FIG. 8. In addition, the electronic device 600 may include a plurality of ports for communicating a video card, a sound card, a memory card, a universal serial bus (USB) device, other electronic device, etc. Although FIG. 10 illustrates the electronic device 600 as a smart-phone 700, the electronic device 600 may alternatively be or include a tablet, personal computer, television, or another device.

The processor 610 may perform various computing functions. The processor 610 may be a microprocessor, a central processing unit (CPU), or another processing device. The processor 610 may be coupled to other components via an address bus, a control bus, a data bus, etc. In one embodiment, the processor 610 may be coupled to an extended bus such as peripheral component interconnect (PCI) bus.

The memory device 620 may store data for operations of the electronic device 600. For example, the memory device 620 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile DRAM device, etc. The storage device 630 may be a solid state drive (SSD) device, a hard disk drive (HDD) device, a CD-ROM device, etc.

The I/O device 640 may be an input device such as a keyboard, a keypad, a touchpad, a touch-screen, a mouse, etc., and an output device such as a printer, a speaker, etc. In one example embodiment, the display device 660 may be included in the I/O device 640. The power supply 650 may provide a power for operations of the electronic device 600. The display device 660 may communicate with other components via the buses or other communication links. As described above, the display device 660 may include a display panel, a power supplier, a loading effect controller, a data driver, a scan driver, and a timing controller.

A detecting line may be formed in the display panel. The detecting line may be coupled to a first power supply line in the display panel. A first power voltage may be supplied through the first power supply line. The first power voltage generated in a power supplier may be provided to each pixel of the display panel through the first power supply line. The detecting line may be coupled to the first power supply line at a predetermined position relative to (e.g., one far from) the voltage supplier that supplies the first power voltage.

The loading effect controller may correspond to any of the aforementioned embodiments. The loading effect controller calculates an amount of the load of the display panel based on a difference between the first power voltage detected from the display panel and a predetermined first reference voltage, determines a control amount of a load based on the calculated amount of the load and a loading effect setting, and controls a gamma reference voltage based on the determined control amount of the load.

The loading effect controller may include, for example, a detecting unit, a load controlling unit, a gamma reference voltage generating unit, and the detecting line. The detecting unit measures the first power voltage in the display panel through the detecting line. The detecting unit measures the first power voltage of the first power supply line which experiences a voltage drop through the detecting line, because the detecting line is coupled to the first power supply line at the predetermined position relative to (e.g., an intermediate position or far from or even an outermost position relative to) the voltage supplier.

The detecting unit detects the amount of load of the display panel by comparing the first power voltage with the predetermined first reference voltage. The detecting unit outputs the first voltage corresponding to the detected amount of the load. The load controlling unit determines a control amount of the load based on the detected amount of load and the loading effect setting from the timing controller, and outputs a second voltage corresponding to the determined control amount of the load.

The loading effect setting may determine, for example, the magnitude and/or polarity of the control amount of the load. The loading effect setting may, for example, be stored in the timing controller during a manufacturing process and/or may be input to the timing controller when the display device is driven.

The load controlling unit may include a first decoder and a second decoder. The first decoder determines the magnitude of the control amount of the load based on the detected amount of the load and the loading effect setting. The second decoder determines a polarity of the control amount of the load based on the loading effect setting.

The gamma reference voltage generating unit controls the gamma reference voltage based on the control amount of the load determined by the load controlling unit. The gamma reference voltage generating unit generates the gamma reference voltage to be higher than the second reference voltage when the second voltage has a positive value. In this case, outside visibility of the display device may be improved by increasing the voltage levels of the gamma voltages generated by the gamma voltage generating unit. The gamma reference voltage generating unit generates the gamma reference voltage to be lower than the second reference voltage when the second voltage has a negative value. In this case, color accuracy of the display device may be improved by decreasing the voltage levels of the gamma voltages that are generated in the gamma voltage generating unit.

The scan driver provides a scan signal to the pixels via scan lines SLn. The data driver may provide a data signal to the pixels via data lines DLm according to the scan signal. The timing controller generates a control signal to control the data driver and the scan driver.

The electronic device 600 of FIG. 9 may include the display device 660 that controls the gamma reference voltage according to the amount of load and the loading effect setting. The display device 660 measures the first power voltage in the display panel through the detecting line, calculates the amount of the load of the display panel by comparing the measured first power voltage with the first reference voltage, and generates the gamma reference voltage by determining the control amount of the load based on the amount of load and the loading effect setting. Thus, color accuracy and visibility of the display panel may be improved.

The aforementioned embodiments may be applied to an organic light emitting display device and an electronic device having the organic light emitting display device. In addition to a smart phone, examples of the electronic device include a computer monitor, a laptop, a digital camera, a cellular phone, a smart pad, a television, a personal digital assistant (PDA), a portable multimedia player (PMP), a MP3 player, a navigation system, a game console, a video phone, etc.

In accordance with another embodiment, a controller determines a control amount of a load of a display panel based on a detected amount of the load of the display panel and a loading effect setting, and to output a voltage corresponding to the control amount of the load. The voltage is to be sent through the output to a gamma reference voltage generator to control a gamma reference voltage. The controller may measure a power voltage at a predetermined position in the display panel and to detect the amount of the load of the display panel by comparing the measured first power voltage with a reference voltage. The controller may correspond, for example, to one or more of the detecting unit 120, load controlling unit 140, or the gamma reference voltage generating unit 160 in FIG. 1. The controller may be embodiment in an integrated circuit chip. The output may correspond to an output port of the chip, a signal line, or another type of interface.

The controllers, detectors, generators, decoders, and other processing features of the invention may be implemented in logic which, for example, may include hardware, software, or both. When implemented at least partially in hardware, the controllers, detectors, generators, decoders, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the controllers, detectors, generators, decoders, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

By way of summation and review, in operation, a display may experience a voltage drop that is based on resistance associated with one or more power supply lines and a loading effect. For example, the voltage drop may change based on changes in the loading effect. This may have an adverse influence on gamma voltages that are used to generate images. As a result, display quality may be significantly degraded.

In accordance with one or more of the aforementioned embodiments, a loading effect control device measures a power voltage in a display panel through a detecting (monitoring) line, calculates an amount of load of the display panel by comparing the measured power voltage to a reference voltage, and generates a gamma reference voltage by determining a control amount of the load based on the amount of the load and a loading effect setting.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. An organic light emitting display device, comprising:

a display panel including a plurality of pixels;

a power supplier to provide a first power voltage and a second power voltage to the display panel;

a loading effect controller to calculate a difference between the first power voltage measured from the display panel and a predetermined first reference voltage, the difference corresponding to a detected amount of a load of the display panel, determine a control amount of the load based on the detected amount of the load and a loading effect setting, and to control a gamma reference voltage based on the determined control amount of the load;

a data driver to provide a data signal to the display panel;

a scan driver to provide a scan signal to the display panel; and a timing controller to generate a control signal to control the data driver and the scan driver, wherein the loading effect controller includes a first decoder to determine a magnitude of the control amount of the load based on the detected amount of the load and the loading effect setting, and a second decoder to determine a polarity of the control amount of the load based on the loading effect setting.

2. The display device as claimed in claim 1, wherein the loading effect controller includes:

a detecting line coupled a first power supply line in the display panel, the first power supply line to provide a first power voltage;

a detector to measure the first power voltage in the display panel through the detecting line, to detect to the amount of the load of the display panel by comparing the measured first power voltage with a predetermined first reference voltage, and to output a first voltage corresponding to the detected amount of the load;

a load controller to determine the control amount of the load based on the detected amount of the load and the loading effect setting and to output a second voltage corresponding to the determined control amount of the load; and a gamma reference voltage generator to control the gamma reference voltage based on the determined control amount of the load.

3. The display device as claimed in claim 2, wherein the detector is to measure the first power voltage of the first power supply line at a position in which a voltage drop occurs.

4. The display device as claimed in claim 2, wherein the detector includes a comparator to output the first voltage based on a difference between the first power voltage and the predetermined first reference voltage.

5. The display device as claimed in claim 2, wherein the predetermined first reference voltage is based on the first power voltage measured when a white image is displayed on the display panel.

6. The display device as claimed in claim 2, wherein the gamma reference voltage generator includes an operational amplifier to add the second voltage corresponding to the control amount of the load to a predetermined second reference voltage.

7. The display device as claimed in claim 1, wherein the first decoder is to:

generate divided voltages by dividing the first voltage based on a predetermined ratio, and output one of the divided voltages as a third voltage based on the loading effect setting.

8. The display device as claimed in claim 7, wherein the second decoder includes:

an inverter to reverse a polarity of the third voltage; and a buffer to maintain the polarity of the third voltage.

9. The display device as claimed in claim 8, wherein the first decoder is to be selectively coupled to the inverter or the buffer.

10. A loading effect control device, comprising:

a detecting line coupled to a first power supply line in a display panel, the first power supply line to provide a first power voltage;

a detector to measure the first power voltage in the display panel through the detecting line, to detect an amount of a load of the display panel by comparing the measured first power voltage with a predetermined first reference voltage, and to output a first voltage corresponding to the detected amount of the load;

a load controller to determine a control amount of the load based on the detected amount of the load and a loading effect setting and to output a second voltage corresponding to the determined control amount of the load; and a gamma reference voltage generator to control a gamma reference voltage based on the determined control amount of the load, wherein the load controller includes a first decoder to determine a magnitude of the control amount of the load based on the detected amount of the load and the loading effect setting, and a second decoder to determine a polarity of the control amount of the load based on the loading effect setting.

11. The control device as claimed in claim 10, wherein the detector is to measure the first power voltage of the first power supply line at a position in which a voltage drop occurs.

12. The control device as claimed in claim 10, wherein the first voltage is based on a difference between the first power voltage and the first reference voltage.

13. The control device as claimed in claim 10, wherein the predetermined first reference voltage is based on the first power voltage measured when a white image is displayed on the display panel.

14. The control device as claimed in claim 10, wherein the first decoder is to:

generate divided voltages by dividing the first voltage based on a predetermined ratio, and output one of the divided voltages as a third voltage based on the loading effect setting.

15. The control device as claimed in claim 14, wherein the second decoder includes:

an inverter to reverse a polarity of the third voltage; and a buffer to maintain the polarity of the third voltage.

16. The control device as claimed in claim 15, wherein the first decoder is to be selectively coupled to the inverter or the buffer.

17. The control device as claimed in claim 10, wherein the gamma reference voltage generator includes an operational amplifier to add the second voltage corresponding to the control amount of the load to a second reference voltage.

18. An apparatus, comprising:

an output; and a controller to determine a control amount of a load of a display panel based on a detected amount of the load of the display panel and a loading effect setting, and to output a voltage corresponding to the control amount of the load, wherein the voltage is to be sent through the output to a gamma reference voltage generator to control a gamma reference voltage, wherein the controller is to measure a power voltage at a predetermined position in the display panel and to detect the amount of the load of the display panel by comparing the measured first power voltage with a reference voltage, and wherein the controller includes a first decoder to determine a magnitude of the control amount of the load based on the detected amount of the load and the loading effect setting, and a second decoder to determine a polarity of the control amount of the load based on the loading effect setting.

* * * * *